United States Patent [19]

Alderman

[11] 4,075,806

[45] Feb. 28, 1978

[54] ROOF WITH INSULATED PURLIN

[76] Inventor: Robert Joe Alderman, 812 59th St., NW., Bradenton, Fla. 33505

[21] Appl. No.: 646,648

[22] Filed: Jan. 5, 1976

Related U.S. Application Data

[63] Continuation-in-part of Ser. No. 494,097, Aug. 2, 1974, Pat. No. 3,969,863, and Ser. No. 638,329, Dec. 8, 1975.

[51] Int. Cl.[2] ..... E04B 2/28; E04B 2/60

[52] U.S. Cl. ..... 52/403; 52/90; 52/407; 52/478; 52/488

[58] Field of Search ..... 52/90, 573, 346, 347, 52/364, 478, 479, 480, 483, 393, 403, 402, 394, 395, 407, 488

[56] References Cited

U.S. PATENT DOCUMENTS

| | | | |
|---|---|---|---|
| 107,290 | 9/1870 | Reynolds | 52/521 |
| 1,156,335 | 10/1915 | Waugh | 52/395 X |
| 2,287,400 | 6/1942 | Wells, Jr. | 52/407 X |
| 2,602,408 | 7/1952 | Smith-Johannsen | 52/394 X |
| 2,945,653 | 7/1960 | Atkin | 52/573 |
| 3,164,227 | 1/1965 | Davis, Jr. et al. | 52/364 |
| 3,513,614 | 5/1970 | Studzinski | 52/743 |

*Primary Examiner*—Alfred C. Perham
*Attorney, Agent, or Firm*—Jones, Thomas & Askew

[57] ABSTRACT

A roof structure is formed with a plurality of substantially parallel purlins mounted on rafters, with each purlin including a central web and a laterally extending upper flange. The upper flange of each purlin defines a plurality of equally spaced openings therethrough, and layers of insulation material are applied to the upper and lower surfaces of the upper flange. Sheets of hard roofing material are mounted on the purlins and fasteners are inserted through the sheets of roofing material and extend down through the openings in the upper flanges of the purlins and through the layers of insulation material so that the sheets of roofing material and fasteners are isolated by the insulation material from the purlins. Additional insulation material is located between adjacent ones of the purlins below the sheets of hard roofing material.

10 Claims, 3 Drawing Figures

ROOF WITH INSULATED PURLIN

CROSS-REFERENCE TO RELATED APPLICATIONS

This application is a continuation-in-part of my prior U.S. applications Ser. No. 494,097, filed Aug. 2, 1974 now U.S. Pat. No. 3,969,863, and Ser. No. 638,329 filed Dec. 8, 1975.

BACKGROUND OF THE INVENTION

Roof structures of industrial buildings typically comprise roof or rafter beams which extend parallel to one another across the building in an inclined attitude and purlins mounted on the rafters which extend parallel to one another and normal to the rafters. In the past, when a roof structure of this type was insulated, long sheets of insulation material were usually spread over the purlins with the lengths of the sheets extending normal to the lengths of the purlins, and hard roofing material was attached to the purlins through the insulating material.

Recently, it has become more desirable to increase the effectiveness of the insulation of roof structures so as to further reduce the heat loss out through the roof structures during the colder winter months and to further reduce the heat transfer inwardly through the roof during the hotter summer months for the purpose of saving energy. When additional layers or thicknesses of insulation material are added to the prior art roof structures, the hard roofing material is displaced further from the supporting purlins and the hard roofing material tends to move or "work" with respect to the purlins and intermediate insulation materials as the hard roofing material expands and contracts due to increases and decreases in its temperature and as it moves in response to wind forces. Moreover, as the thickness of the insulation material between the purlins and the hard roofing surface increases, it is more difficult to place and hold the insulation material on the purlins and to attach the hard roofing surface to the purlins through the thicker insulation material.

As shown in my prior U.S. Pat. No. 3,559,914, I have developed a system for applying insulation material to the purlins of roof structures where the long strips of insulation material extend parallel to the purlins. As shown in my more recent copending applications, I have further developed a system for supporting and applying increased thicknesses of insulation material to the roof structure of a building where the insulation material is located between adjacent ones of the purlins. While these systems are effective in insulating a typical roof structure, it is also desirable to reduce heat conduction between the hard sheet roofing material and the purlins so as to prevent the purlins from transferring heat through the roof structure. While my prior applications disclose the application of insulation material to the top surfaces of the purlin to reduce the conduction of heat between the hard sheets of roofing material and the purlin, the fasteners which connect the hard sheets of roofing material to the purlins still function as a heat transfer medium between the purlins and the hard piece of roofing material.

SUMMARY OF THE INVENTION

Briefly described, the present invention comprises a roof structure which includes means for insulating the purlins of the roof from the hard sheets of roofing material supported by the purlins. The upper flanges of the purlins define equally spaced openings therethrough and layers of insulation material are applied to both the upper and lower surfaces of the upper flanges of the purlins. Fasteners extend from the hard sheets of roofing material down through the openings in the upper flanges of the purlins and through the layers of insulation material. The openings in the upper flanges of the purlins are larger than the fasteners so that the fasteners do not contact the purlins, thus isolating the fasteners from the purlins. The layers of insulation material can be provided in the form of an elongated insulator shoe that is slipped about and straddles the upper laterally extending flange of each purlin.

The roof structure also includes a lattice of support straps extending through and supported by openings in the central webs of the purlins, and additional layers of insulation material are supported by the support straps between the central webs of adjacent ones of the purlins.

Thus, it is an object of this invention to provide a new and useful roof structure which functions to insulate the hard sheets of roofing material from the lower supporting purlins.

Another object of this invention is to provide a roof structure which minimizes the heat transfer therethrough.

Another object of the present invention is to provide a roof structure in which the fasteners are insulated from the purlins to inhibit conduction heat transfer from the fasteners to the purlins.

Another object of the invention is to provide a purlin for use in combination with a roof structure wherein the upper laterally extending flange of the purlin has insulation material applied thereto.

Another object of this invention is to provide a metal building structure in which the outside layer of the building such as the sheets of external roofing material or sheets of external wall material are insulated from the internal supporting structure.

Other objects, features and advantages of the present invention will become apparent upon reading the following specification, when taken in conjunction with the accompanying drawing.

DETAILED DESCRIPTION

Figure 1:
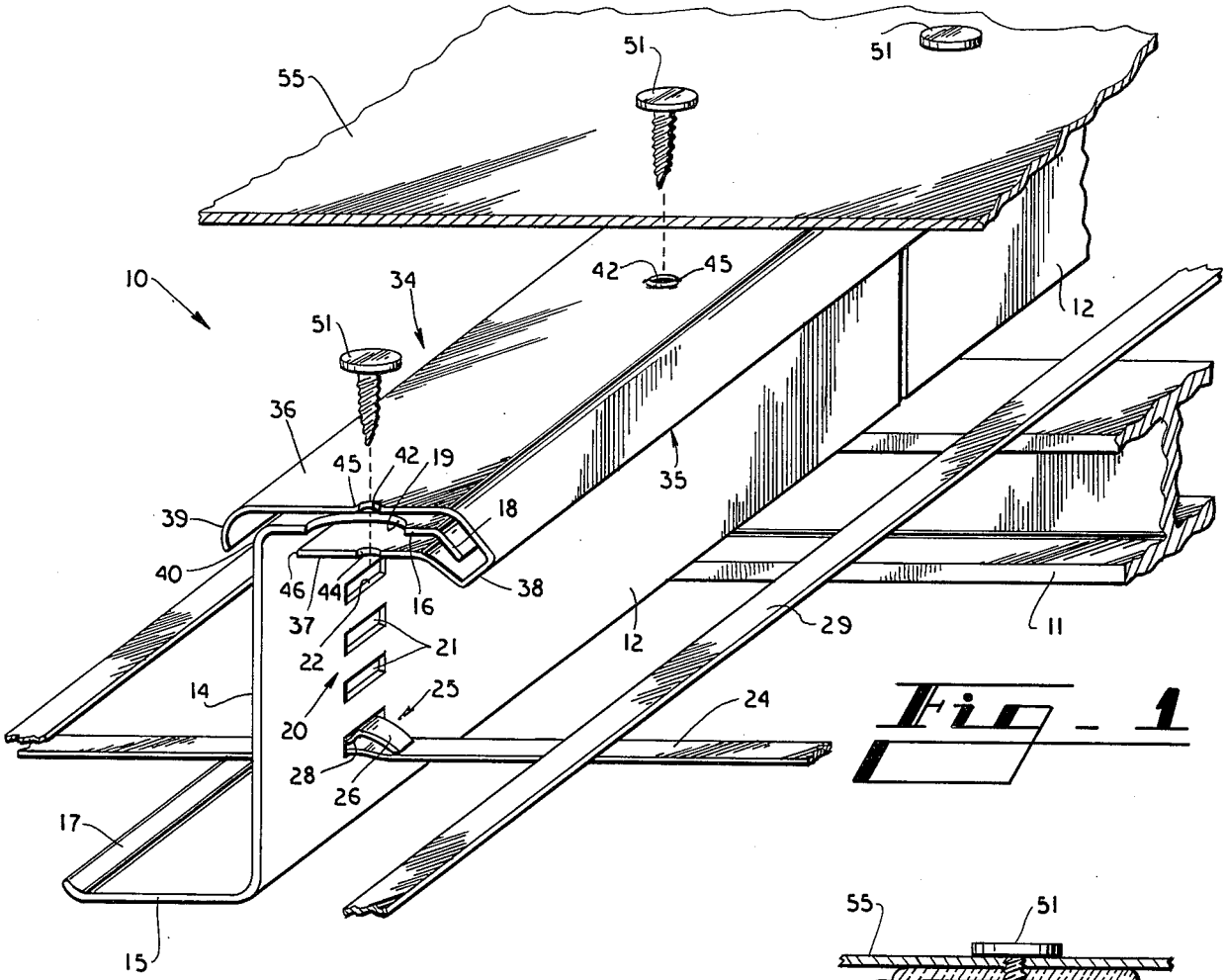
FIG. 1 is a partial perspective illustration of the purlin as it is mounted on a roof structure with the insulation material being removed for clarity.

Referring now in more detail to the drawing, in which like numerals indicate like parts throughout the several views, FIG. 1 illustrates a portion of a roof structure 10 which includes a plurality of rafters 11 (only one illustrated) which extend in spaced parallel relationship with one another and which are inclined along their lengths downwardly from the center beam of the building structure. A plurality of purlins 12 (only one illustrated) are positioned in spaced, approximately parallel relationship with respect to one another and rest on the top surface of the rafters 11. Each purlin comprises a central web 14, a lower laterally extending flange 15 and an upper laterally extending flange 16.

The lower and upper flanges 15 and 16 extend in opposite lateral directions from the lower and upper portions of central web 14. Each flange terminates at its distal end in a rim 17 and 18 which are turned back toward central web 14. The configuration of each purlin 12 is such that it is approximately Z-shaped in cross section, and this configuration allows the purlin to be fabricated from relatively thin light material and retains enough strength to form adequate support in a typical roof structure.

In the embodiment illustrated, each purlin 12 is supported at its ends by adjacent ones of the rafters 11, and the purlins are parallel to one another, perpendicular to the rafters and each purlin extends in a horizontal attitude along its length and its central web 12 extends upwardly.

The central web 14 of each purlin defines a plurality of groups of openings 20 at equally spaced intervals along the lengths of the purlins, with each group 20 of openings comprising a plurality of openings 21 arranged in upwardly spaced relationship with respect to one another. Each opening 21 includes at least one substantially flat surface 22. A plurality of support straps 24 are located in the roof structure, with the support straps 24 extending through one of the openings 21 in the groups of openings 20. In the embodiment illustrated, the straps 24 extend through the lowermost opening 21 in each group. A clip 25 is inserted into the opening above the support strap 24 to cause the support strap to frictionally engage the substantially flat surface 22 of the opening. Each of the clips 25 includes a pair of legs 26 that extend outwardly and are inclined downwardly from a raised central area, and a recess 28 is formed in the raised central area. The clip is usually placed on top of the support strap 24 and moved along the strap into the opening 22 until its recess 28 is positioned in the opening. The downwardly and outwardly diverging legs 26 are shaped and are of a size so as to bias or urge the strap 24 downwardly into engagement with the flat surface 22 of the opening in the central web of the purlin, to cause the support strap 24 to frictionally engage the substantially flat surface 22 of the opening. When tension is applied to the strap 24, the portion of the strap extending through the opening tends to engage the flat portion of the opening with more force, increasing the static friction between the bottom surface of the support strap 24 and the substantially flat surface 22 of the opening. Thus, clip 25 functions as a fastener and a means for connecting the support straps 24 to the purlin.

If desired, secondary insulation support straps 29 extend across and are supported by the support straps 24. The straps 24 or the straps 24 together with straps 29 form a lattice of supporting straps in the roof structure.

Figure 2:
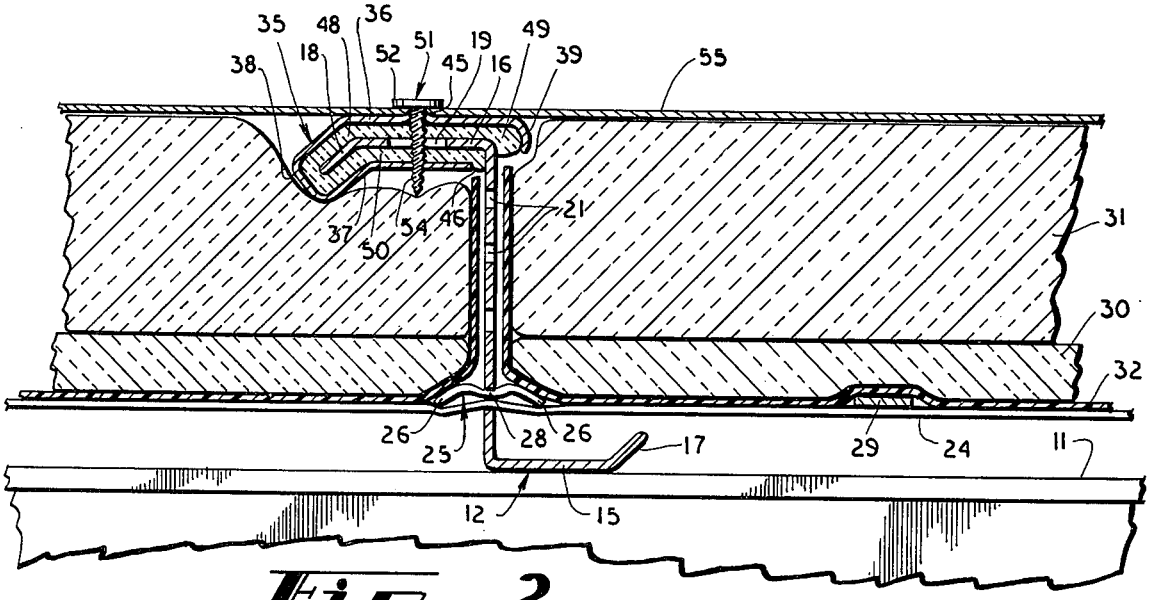
FIG. 2 is a side cross sectional view of a small portion of a roof structure with the insulation material illustrated.

As illustrated in FIG. 2, insulation material is placed on the lattice of straps. The insulation material can comprise one or more strips or webs of sheet material or a single lower sheet and loose insulation material placed on the sheet, and the thickness of the insulation material can vary. In the embodiment illustrated herein, the insulation material comprises two layers of strips of material, including a lower layer 30 and an upper layer 31. The lower layer 30 includes a layer of vapor impermeable substance such as vinyl sheet 32 applied to the lower surface of the lower layer which is positioned to contact the lattice of straps 24 and 29. The lower layer 30 is thinner than the upper layer 31, and both layers are of a width sufficient to reach substantially between the central webs 14 of adjacent ones of the purlins 12 and of a height sufficient to fill the vertical space between the lattice of straps and the hard roofing material. Apparatus suitable for inserting the insulation material is disclosed in my prior U.S. Pat. No. 3,559,914.

A plurality of holes or openings 19 are formed at equally spaced intervals in the upper flange 16 of each purlin, with the openings extending along the lengths of the purlins. Similar openings can be formed through the lower flange 15 of the purlin, if desired (not shown).

Insulator means 34 in the form of elongated insulator shoes 35 are applied to the upper flange 16 of the purlins. Each elongated insulator shoe 35 comprises a single sheet of substantially hard material, such as sheet aluminum, and the sheet of material is formed with upper and lower strips or returns 36 and 37 which are positioned above and below the upper flange 16 of the purlin. The insulator shoe has an approximately U-shaped bend 38 that extends about the rim 18 of the upper flange 16 of the purlin, and the upper return 36 terminates in a downwardly turned rim 39 that extends about the L-shaped bend 40 at the junction between the upper flange 16 and the central web 14 of the purlin.

A plurality of holes or openings 42 are formed in the upper return of insulator shoe 35, while a plurality of holes or openings 44 are formed in the lower return 36 of the insulator shoe 35, and openings 42 and 44 are aligned with one another. The spacing of openings 42 and 44 along the length of insulator shoe 35 corresponds with the spacing of the openings 19 in the upper flange of the purlin, so that the openings 19, 42 and 44 will be in registration with one another. The openings 42 in the upper return 36 of the insulated shoe are punched so that they leave a projecting circular rim or dimple 45 in the insulator shoe material which projects above the plane of the upper surface of the upper return 36.

As is illustrated in FIG. 2, the upper and lower returns 36 and 37 of the sheet material of insulator shoe 35 are spaced from the upper flange 16 of the purlin, with the inner edge 46 of the lower return 37 terminating short of the central web 14 of the purlin. Insulation material, such as a folded web of insulation material 48 of a type that is a poor conductor of heat forms a part of insulator shoe 35 and is located in the space between the sheet material of the insulator shoe and the upper flange of the purlin. The web 48 of insulation material comprises an upper strip 49 which contacts the upper surface of upper flange 16 and a lower strip 50 which contacts the lower surface of upper flange 16.

Fastener 51 comprises a rivet member having a cap 52 and an externally threaded shank 54. Hard sheets of roofing material 55 extend across and are supported by purlins 12, with the lower surface of the sheets of roofing material engaging the upper return 36 of insulator shoe 35. When the sheets of roofing material 55 are to be applied to the purlins, the sheets of material are placed across the purlins and a worker uses a rubber hammer to pound the roofing material toward engagement with the upwardly flaired circular rim or dimple 45 of the holes in the upper return 37 of the insulator shoes 35 so that the rims 45 make an impression in the hard sheet roofing, thereby locating the holes in the purlins. The worker then drives the rivet member 51 down through the impression which is in alignment with the holes in the insulator shoe and purlin, and the rotation of the rivet members 51 causes the threads of the shank of the rivet to engage and lock into the smaller hole 44 in the lower return 37 of the insulator shoe. Since the holes 19 in the upper flanges of the purlins are much larger than the diameter of the shank of the rivet members, the rivet members 51 will not engage the purlin. In the embodiment illustrated, the holes 19 in the upper flanges of the purlins are 6 inches apart along the length of the purlin, and the holes are one inch diameter circular holes, and the holes in the upper return of the insulator shoe are ¼ inch diameter and the holes in the lower return of the insulator shoe are 3/16 inch diameter.

Figure 3:
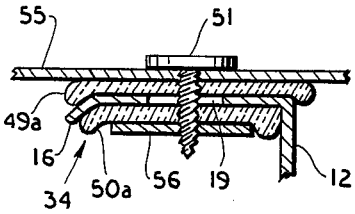
FIG. 3 is a detail side illustration of a modified form of the invention.

As is illustrated in FIG. 3, the insulator means 34 can comprise an upper strip 49*a* of insulation material and a lower strip 50*a* of insulation material which are separated from each other, and a strip of hard material such as sheet aluminum 56 is applied to the lower surface of the lower strip 50*a* of insulation material. When the rivet member 51 is projected through the sheets of roofing material 55, it will anchor into the strip 56 of hard material and the layers of insulation material 49*a* and 50*a* will prevent the sheets of roofing material, rivet and strip of material 56 from contacting the purlin 12. The strip 56 can also comprise individual fasteners which engage the threads of the rivet members 51 and which are large enough to avoid being drawn through the hole 19 in the upper flange 16 of the purlins.

When the hard sheets of roofing material 55 are subjected to intense heat from sun radiation, etc., the heat can be conducted throughout the roofing material and into the fasteners 51 and into the hard sheet material of the insulator shoe 35 (FIGS. 1 and 2) or into the fastener strip 56 (FIG. 3), but all of these elements are insulated and isolated from purlin 12, so that heat is not transferred by direct contact or conduction to the purlin. In addition, the layers of insulation material 30 and 31 located substantially below the insulator shoe 35 prevent heat from a hot roof from transferring downwardly from the hard roofing material by convection or radiation to the area below the roof structure. The reverse situation is present when the building structure is heated from the inside and the temperature of the air and other weather conditions outside the building are cold.

In the roof structures where the purlins are nested at their ends on top of the rafters, the insulator shoe is formed shorter than the purlin, and the exposed end of one purlin is inserted into the insulator shoe of the portion of the other purlin with which it overlaps.

The purlin disclosed herein is illustrated as being located in the roof structure of a building, but it will be understood by those skilled in the art that the purlin can be used in other combinations, such as a girt in a wall structure and function to support the external sheets of wall material and insulate the fastener and sheets of wall material from the internal building supporting structure. Thus, the term "purlin" as used herein is to be construed broadly so as to include similar devices used in various structural environments. Moreover, while the disclosed roof structure is described as comprising sheets of insulation material 30 and 31, it will be understood that loose insulation mixed with an adhesive can be sprayed onto the purlins, etc., from inside the building, if desired.

While this invention has been described in detail with particular reference to preferred embodiments thereof, it will be understood that variations and modifications can be effected within the spirit and scope of the invention as described hereinbefore and as defined in the appended claims.

I claim:

1. A roof structure comprising a plurality of rafters and the like oriented in spaced approximately parallel relationship with respect to one another, a plurality of purlins supported by said rafters in spaced approximately parallel relationship with respect to one another and extending across said rafters, each of said purlins including an upper laterally extending flange, sheets of hard roofing material and the like supported by the upper laterally extending flanges of said purlins, fasteners connecting said sheets of hard roofing material to the upper laterally extending flanges of said purlins, a strip of insulation material positioned in abutment with the lower surface of the upper flanges of said purlins and extending along the length of the purlins, and a strip of hard material supported by said purlin and juxtaposed the lower surface of the layer of insulation material and extending along the length of the purlins, the upper flange of each of said purlins defining a series of openings therethrough, and said fasteners comprising rivet members each including a shank of a diameter smaller than the openings in the upper flanges of said purlins extending from the sheets of hard roofing material down through the openings of the upper flanges of said purlins without contacting the purlins, and through the layer of insulation material and into the layer of hard material, whereby said fasteners can be inserted into the roof structure from above the sheets of hard roofing material without requiring access to the space below the sheets of hard roofing material.

2. A roof structure and the like comprising in combination a plurality of purlins positioned in spaced approximately parallel relationship, each of said purlins comprising a central upwardly extending web and an upper flange extending laterally from the upper portion of said central web and a series of holes formed in said upper flange, sheets of hard roofing material mounted on said purlins, a layer of insulation material positioned between the upper surfaces of said upper flanges of said purlins and the sheets of hard roofing material to inhibit conduction heat transfer between the sheets of hard roofing material and said purlins, and insulator means including a strip of heat insulating material positioned adjacent the lower surface of the upper flange of said purlins and extending along the length of the purlins and extending over the holes in said flange and supported by said purlins for receiving a fastener, and fasteners extending downwardly from the sheets of hard roofing material through the holes in the upper flanges of the purlins without contacting the flanges and extending into the strip of heat insulating material.

3. The roof structure of claim 2 and wherein the central web of said purlins define openings therein, further including support straps extending through said central web openings, and insulation material supported by said support straps.

4. The roof structure of claim 2 and further including insulation material located between the central webs of adjacent ones of said purlins.

5. In combination, a purlin for use in a roof structure or the like comprising a central web and a laterally extending flange, said flange defining a series of equally spaced openings therethrough along its length, an elongated insulator shoe mounted about the flange of said purlin and comprising an upper return positioned over the flange of said purlin and a lower return positioned beneath the flange of said purlin, said upper return of said elongated insulator shoe defining a series of openings therethrough along its length in registration with the openings of said flange, the openings in said upper return being smaller than the openings in said flange.

6. The combination of claim 5 and wherein the series of openings defined in the upper return of said elongated insulator shoe are characterized by having been punched upwardly and including an upwardly projecting rim of insulator shoe material surrounding the openings.

7. In combination, purlins for use in a roof structure and the like each comprising a central web and a laterally extending flange, and an elongated insulator shoe mounted about the flange of each of said purlins and comprising an upper return positioned over the flange of said purlin and a lower return positioned beneath the flange of said purlin, a series of equally spaced openings defined in the flange of said purlin and a series of equally spaced openings of smaller size defined in said insulator shoe, with the holes of said insulator shoe being in registration with the holes of said flange.

8. The combination of claim 7 and wherein said purlins are positioned in approximately parallel spaced relationship, and further comprising sheets of roofing material and the like engaging the upper return of said insulator shoe, and fasteners projecting through said sheets of roofing material, said elongated insulator shoes and the upper flange of said purlin.

9. A roof structure comprising a plurality of rafters and the like oriented in spaced approximately parallel relationship with respect to one another, a plurality of purlins supported by said rafters in spaced approximately parllel relationship with respect to one another and extending across said rafters, each of said purlins including an upper laterally extending flange defining a series of holes at spaced intervals along its length, sheets of hard roofing material and the like supported by the upper laterally extending flanges of said purlins, fasteners connecting said sheets of hard roofing material to the upper laterally extending flanges of said purlins, and an elongated insulator shoe mounted on and extending along the upper flange of each of said purlins with each insulator shoe comprising a sheet of metal and the like bent about and straddling the upper flange of a purlin, a layer of insulation material extending between said sheet of metal and the upper and lower surfaces of the upper flange of each of said purlins and maintaining the sheet of metal in spaced relationship with respect to said purlin, and wherein said fasteners comprise rivet members extending from above and down through said sheets of hard roofing material, through the openings in the upper flanges of said purlins and through said insulator shoe.

10. In combination, a purlin for use in a roof structure and the like comprising a central web and a laterally extending flange, said flange defining a series of equally spaced openings therethrough along its length, an elongated insulator shoe mounted about the flange of said purlin and comprising an upper return positioned over the flange of said purlin and a lower return positioned beneath the flange of said purlin, said upper return of said elongated insulator shoe defining a series of openings therethrough along its length in registration with the openings of said flange, and layers of insulation material positioned between the flange of said purlin and said elongated insulator shoe and maintaining said insulator shoe out of contact from said purlin.

* * * * *